United States Patent [19]

Byrd

[11] Patent Number: 4,497,312

[45] Date of Patent: Feb. 5, 1985

[54] BREATHING AND RELAXATION PROGRAMS TO AID CHILDBIRTH

[76] Inventor: Brian K. Byrd, P.O. Box 169, Lehigh Acres, Fla. 33936

[21] Appl. No.: 554,536

[22] Filed: Nov. 23, 1983

[51] Int. Cl.[3] ..... G04B 19/06

[52] U.S. Cl. ..... 128/1 R; 368/223

[58] Field of Search ..... 128/1 R; 40/489, 496, 40/491, 611; 368/41, 223, 222, 232

[56] References Cited

U.S. PATENT DOCUMENTS

| | | | |
|---|---|---|---|
| 315,322 | 4/1885 | Nelson | 368/223 |
| 619,078 | 2/1899 | Handly | 368/41 X |
| 885,503 | 4/1908 | Miller | 368/41 X |
| 1,572,884 | 2/1926 | Colvin | 368/228 X |
| 1,838,962 | 12/1931 | Schluich | 40/489 |
| 3,452,540 | 7/1969 | Backo | 368/41 X |
| 3,777,475 | 12/1973 | Grossan | 368/223 |
| 4,208,870 | 6/1980 | Cullom | 368/41 |

FOREIGN PATENT DOCUMENTS

| | | | |
|---|---|---|---|
| 102573 | 12/1923 | Switzerland | 368/41 |
| 19534 | of 1915 | United Kingdom | 368/41 |

*Primary Examiner*—Edward M. Coven

*Attorney, Agent, or Firm*—Alfred E. Wilson

[57] ABSTRACT

This invention is based on the hypothesis that a controlled and directed program of breathing and relaxation can assist the normal bodily functions that are brought into action as the time for child delivery approaches to be more effective in the delivery of the child. These procedures will enable the expectant mother to take full advantage of the powerful bodily functions which are set in motion as the time for child delivery approaches to assist the normal child delivery cycle so that the process of child bearing can be materially easier. A unique breathing program, including several precise breathing patterns and exercises timed in relation with a timepiece having a second hand are provided in the form of a series of transparent overlays for the timepiece. Each overlay has a suggested time related breathing pattern to be successively superimposed on the timepiece to indicate to the expectant mother successive time related breathing patterns to be practiced and used by her prior to, and at the time of delivery to enable her to relax and to assist the normal bodily functions, including the contractions that are brought into action as the time for child delivery approaches to force the child to move in the delivery cycle.

7 Claims, 6 Drawing Figures

BREATHING AND RELAXATION PROGRAMS TO AID CHILDBIRTH

BACKGROUND OF THE INVENTION

Broadly stated this invention is directed to the easing of the pain and suffering that builds up as expectant mothers approach the time of child delivery, by instituting various programs of positive breathing and relaxation directed to inducing a tranquil attitude to facilitate the normal bodily child delivery functions attendant upon child bearing.

FIELD OF THE INVENTION

It has been established that the degree of pain and suffering that the expectant mother is subjected to as her time for delivery approaches, and during childbirth, is in part directly related to the degree of relaxation, and therefore the degree of cooperation which she is able to render to the chain of normal bodily functions which are brought into operation as the time for child delivery approaches, the greater her degree of relaxation the more helpful she will be to the attendant personnel in the delivery.

DESCRIPTION OF THE PRIOR ART

Efforts have heretofore been made to minimize the pain and suffering that is attendant upon childbirth by inducing sustained deep breathing in an effort to attune the body to respond to the normal bodily functions in a more cooperative manner to facilitate the expelling contractions as the time for delivery approaches. These prior efforts have only been partially successful because of the lack of well organized and programmed procedures which can be initiated and followed precisely as the delivery progresses.

SUMMARY OF THE INVENTION

The invention is illustrated as applied to a series of diagrams or charts intended to be superimposed on the face of a timepiece such as a watch or clock having a second hand, to be visible to the expectant mother, and to be used by her to practice the various breathing and relaxation procedures. With these diagrams timed in relation to the second hand of the timepiece she can systematically practice and correlate the relaxation of various portions of her body so that when the time for delivery approaches the routine will be so well established that it is possible to approach the delivery with a relaxed state of mind and body so that the normal bodily functions attendant upon delivery can induce the birth with the mother being as relaxed and pliable as possible whereupon the pains of delivery are minimized.

DESCRIPTION OF THE DRAWINGS

Referring now to the drawings wherein similar reference characters refer to similar parts throughout the various views.

DESCRIPTION OF THE PREFERRED EMBODIMENT

Figure 1:
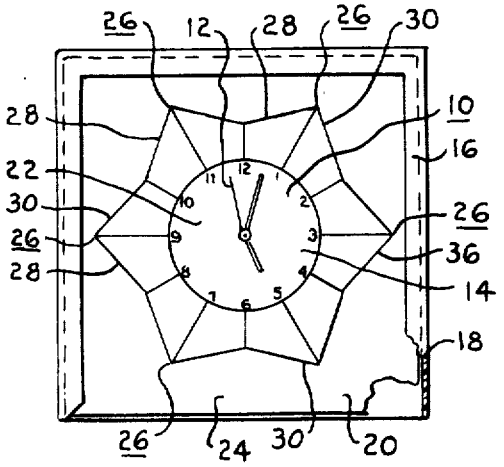
FIG. 1 is a front elevational view, partly in section, of a time-piece having an open ended three sided channeled frame to successively receive inserts each having different breathing patterns superimposed thereon, the breathing pattern insert of FIG. 1 being a slow breathing and relaxing pattern.

Referring now to the drawings, and particularly to FIG. 1, a time-piece 10 is illustrated having a second hand 12 movable relative to a dial 14 having the conventional timepiece numbers thereon. The timepiece 10 has an extended face having a three sided channel shaped frame 16 thereon. The frame 16 has an inwardly directed channel 18 adapted to successively receive inserts or chart overlays 20.

The chart overlays 20 may have an open area 22 adapted to overlie the dial 14 of the timepiece 10 as illustrated in FIG. 1.

It will be apparent that if desired the inserts of chart overlays 20 may be formed of transparent plastic so that when they are inserted in the three sided channel 16 the dial 14 and the second hand 12 of the timepiece 10 is visible through the insert.

Referring now to the insert 20 illustrated in FIG. 1, a slow breathing pattern 24 consisting of six full cycles 26 are superimposed on the face of a timepiece 10 in the three sided frame 16. Each cycle 26 is of ten seconds duration with the six full cycles consuming sixty seconds or a complete revolution of the second hand 12 of the clock or watch 10.

The first part 28 of the cycles 26 consists of approximately five seconds during which time the participant inhales in a controlled rate of slow easy breathing, and during the second phase 30 consisting of approximately the five seconds of the cycle 26, the participant exhales in a controlled rate. These inhaling and exhaling periods can be of equal duration, or they may be of different durations, such for example as where the inhaling period is somewhat less or more than the exhaling period. The participant practices this deep breathing exercise watching the second hand 12 of the timepiece and consciously makes an effort to relax as much as possible throughout her body while this breathing exercise is in progress. This breathing and relaxing process continues for several cycles of operation depending on the participant's physical stamina and desires.

Figure 2:
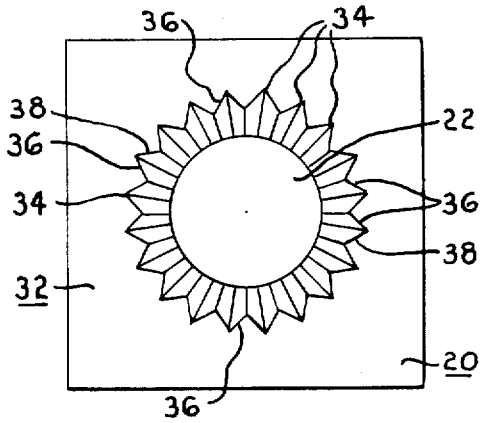
FIG. 2 is a plan view of an insert illustrating a shallower and more rapid breathing and relaxation pattern.

The accelerated breathing and relaxing pattern 32 embodied in the insert 20 of FIG. 2 is substituted on the face of the timepiece 10 for the slow breathing pattern 24 of FIG. 1. This pattern is similar in many respects to that of FIG. 1, but the timing is speeded up considerable as indicated by the act that twenty cycles 34 are employed rather than six cycles as in the FIG. 1 embodiment. In this embodiment the inhaling cycle 36 consumes the first one and one-half seconds of the thee-second cycle 36, and the exhaling cycle 38 consumes the second one-half of each of the cycles 34. This pattern is practiced by the participant for a desired length of time, here again depending on the participant's stamina and desires. It is of importance that the participant relax as much as possible during all of the breathing programs so as to gain the maximum amount of good from the program.

Figure 3:
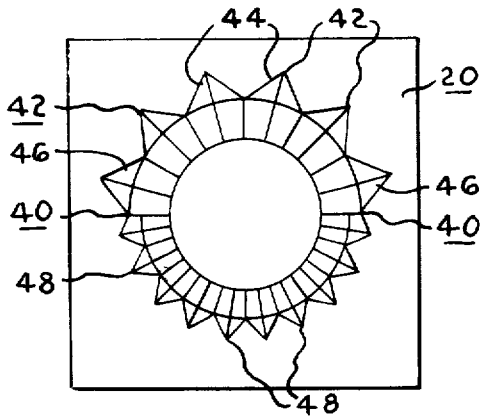
FIG. 3 is a plan view of an insert combining modified breathing patterns similar to portions of FIGS. 1 and 2.

When the participant has engaged in the FIG. 2 exercises a desired number of times, she may then shift to the FIG. 3 embodiment wherein a modified pattern 40 of cycles 42 of five seconds each is established in the upper half of the dial 14 of the watch. These five second cycles 42 are divided into inhaling cycles 44 of two and one-half seconds and exhaling cycles 46 of two and one-half seconds each approximately, combined to make the five second intervals 42 as illustrated on the upper half of FIG. 3. The bottom half of the pattern 40 of FIG. 3 has an accelerated breathing pattern of ten cycles 48 wherein the inhaling portion 50 of each cycle 48 is one and one-half seconds, and the exhaling portion 52 of each cycle 48 is of one and one-half seconds duration.

Figure 4:
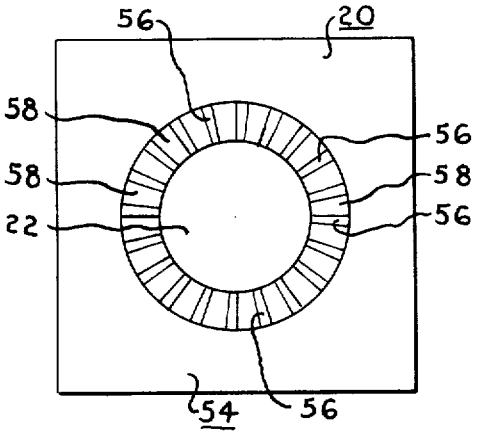
FIG. 4 is a view of an insert wherein a more complicated breathing pattern is provided.

Referring now to the breathing pattern 54 of FIG. 4, the participant practices the art of puffing in short spurts for a one second cycle 56 followed by a two second delay 58 for normal breathing. This exercise is continued until the participant has mastered it, and she can perform the exercise efficiently and comfortably with a high degree of relaxation.

Figure 5:
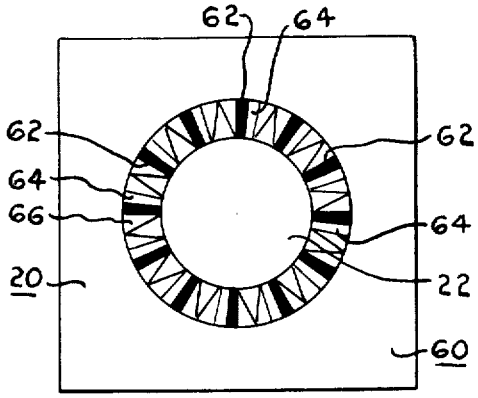
FIGS. 5 and 6 are views of inserts having other modified breathing patterns.

The participant may then progress to the FIG. 5 chart 60, placing an imprint thereof on the face of the timepiece within the three sided frame 16. The FIG. 5 exercise includes a one second puff cycle 62 followed by a one second delay 64 during which time the participant engages in relaxed normal breathing, and this is followed by a three second blow cycle 66 to attune the participant to puffing and blowing through the mouth. This process is repeated until the participant feels comfortable with it in a relaxed manner.

Figure 6:
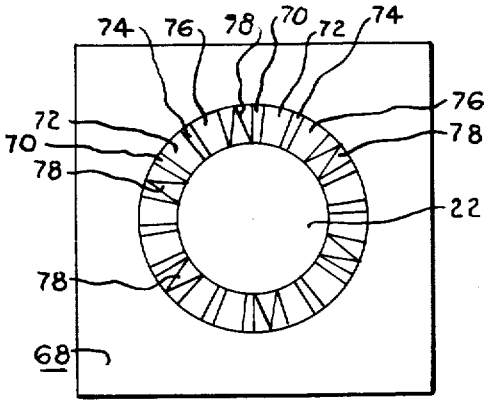

After the FIG. 5 chart has been used sufficiently that the participant can perform the desired functions in a relaxed manner, she places the chart 68 of the FIG. 6 embodiment on the face of the timepiece 10, in the three sided frame 16 and proceeds to breath in accorance with the FIG. 6 program. This entails a one second cycle 70 of breathing in rapid short puffs in a relaxed manner. This is followed by a two and one-half second delay 72 during which time the participant engages in normal relaxed breathing. This breathing and relaxing program is followed by another one second cycle 74 of puffing in short spurts, then followed by another cycle 76 of two and one-half seconds of relaxed normal breathing, and this is followed by a three second cycle 78 of blowing out through the mouth in a relaxed manner.

The fundamental purpose of these exercises as related to child delivery is to attune the expectant mother to relax as the time for delivery approaches, and to enable her to assume and maintain a relaxed attitude as the contractions start and accelerate in frequency, duration and intensity as the time for delivery approaches. In this way she is able to render the maximum assistance to the doctor during the delivery.

It will be apparent that the chart overlays can be divided into any desired number of cycles, and that each cycle can be divided into segments to indicate specific breathing and relaxation programs to assist in the childbirth cycle.

I claim:

1. A breathing and relaxation timing and training device to assist an expectant mother to relax and cooperate with the normal bodily functions including the contractions that are brought into action as the time for child delivery approaches, comprising a timepiece having a dial and a second hand movable relative to the dial, a frame superimposed over the dial and having a channeled frame to successively receive one of a series of chart overlays, each of the chart overlays having a series of time related intervals marked thereon to indicate a specific time related breathing and relaxation pattern, the chart overlays being so proportioned that when a chart overlay is positioned in the channeled frame the dial of the timepiece and the position of the second hand relative to the markings of the dial and the markings of the chart overlay are visible to indicate a specific breathing and relaxation pattern.

2. The invention defined in claim 1 wherein the time related intervals of one of the chart overlays has configurations to indicate approximately six cycles of 10 seconds each, and each cycle is marked to indicate periods of controlled rates of inhalation and exhalation of approximately five seconds each.

3. The invention defined in claim 1 wherein the time related intervals of one of the chart overlays has configurations to indicate approximately twenty cycles of three seconds each, and each cycle is marked to indicate periods of controlled rates of inhalation and exhalation of approximately one and one-half seconds each.

4. The invention defined in claim 1 wherein one half of one of the chart overlays has configurations to indicate approximately six cycles of five seconds each, and the other half of the chart overlay has configurations to indicate approximately ten cycles of three seconds each, and approximately one half of each of said cycles is marked to indicate controlled periods of inhalation and the other half of each of said cycles is marked to indicate controlled periods of exhalation.

5. The invention defined in claim 1 wherein one of the chart overlays has configurations to indicate approximately twenty cycles of three seconds each and wherein the first second of each cycle is devoted to puffing in short spurts, followed by a two second period of normal breathing in each of said cycles.

6. The invention defined in claim 1 wherein one of the chart overlays has configurations to indicate approximately twelve cycles of five seconds each wherein the first second of each cycle is devoted to puffing in short spurts, followed by a one second period for normal breathing, followed by a three second blowing cycle to attune the prospective mother to puffing and blowing through the mouth.

7. The invention defined in claim 1 wherein one of the chart overlays has configurations to indicate approximately six cycles of ten seconds each wherein the first second of each cycle is devoted to puffing in short spurts, followed by a two and one-half second period for normal breathing, followed by another one second of each cycle being devoted to puffing in short spurts, followed by a second two and one-half second portion of the cycle being devoted to normal breathing, followed by a three second portion of each cycle being devoted to blowing.

* * * * *